US006173828B1

(12) United States Patent
Leu et al.

(10) Patent No.: US 6,173,828 B1
(45) Date of Patent: Jan. 16, 2001

(54) APPARATUS FOR ROTATING PRODUCTS ACCUMULATING IN AN IMBRICATED FORMATION

(75) Inventors: Willy Leu, Pfäffikon; Carl Conrad Mäder, Hinwil, both of (CH)

(73) Assignee: Ferag AG, Hinwil (CH)

( * ) Notice: Under 35 U.S.C. 154(b), the term of this patent shall be extended for 0 days.

(21) Appl. No.: 09/151,256

(22) Filed: Sep. 10, 1998

(30) Foreign Application Priority Data

Sep. 10, 1997 (CH) ..... 2132/97

(51) Int. Cl.[7] ..... B65G 47/24; B65G 47/26
(52) U.S. Cl. ..... 198/416; 198/435
(58) Field of Search ..... 198/416, 413, 198/374, 435

(56) References Cited

U.S. PATENT DOCUMENTS

| | | | | |
|---|---|---|---|---|
| 3,332,531 | * | 7/1967 | Chaney | 198/416 |
| 3,809,214 | | 5/1974 | Reist | 198/374 |
| 3,955,667 | | 5/1976 | Müller et al. . | |
| 4,585,227 | * | 4/1986 | Muller | 198/435 |
| 4,607,743 | * | 8/1986 | Elam | 198/415 |
| 5,056,772 | | 10/1991 | Kellum III | 271/184 |
| 5,261,520 | | 11/1993 | Duke . | |
| 5,388,820 | | 2/1995 | Eberle et al. . | |
| 5,395,151 | | 3/1995 | Eberle . | |
| 5,667,214 | * | 9/1997 | Belec et al. | 198/416 |
| 5,706,929 | * | 1/1998 | Easton | 198/415 |

FOREIGN PATENT DOCUMENTS

| | | |
|---|---|---|
| 637 900 A5 | 8/1983 | (CH) . |
| 966402 | 8/1964 | (GB) . |
| 60258038 | 12/1985 | (JP) . |
| WO 98/03422 | 1/1998 | (WO) . |

* cited by examiner

*Primary Examiner*—Robert P. Olszewski
*Assistant Examiner*—Bryan Jaketic
(74) *Attorney, Agent, or Firm*—Brinks Hofer Gilson & Lione

(57) ABSTRACT

An apparatus for rotating rectangular flat articles that have been accumulated in an imbricated formation on and are moving in a conveying direction along a belt conveyor. A stop is arranged in the movement path of the products, on one side relative to the central axis of the incoming imbricated formation. A roller is located on the other side relative to the central axis, the axis of rotation for which extends at a right angle to the conveying direction of the product and is tangent to the stop. The apparatus prevents damage to the products and insures rotation of the products that have been accumulated in imbricated formation.

30 Claims, 7 Drawing Sheets

APPARATUS FOR ROTATING PRODUCTS ACCUMULATING IN AN IMBRICATED FORMATION

BACKGROUND OF THE INVENTION

The present invention relates to an apparatus for rotating rectangular flat products accumulating in an imbricated formation in particular printing-works products.

A similar apparatus is disclosed in Swiss Patent No. 637 900 in which a roller is arranged to engage the corner of leading product in an incoming imbricated formation of products that has been rotated out of the imbricated formation of products as a result the product striking a stop that is arranged on the side opposite the roller relative to the central axis of the incoming imbricated formation. The roller functions to support the further rotation of both the leading product and of the following products that rest on the leading product. The products, after leaving the active range of the roller, are rotated further about the stop as a center of rotation as a result of the friction that is present between the products and the belt conveyor. When the products have traveled around the stop they are conveyed away. In this prior art apparatus, the rotation of the products is caused by the product striking the stop and rotating the product into the active range of the roller. Further rotation of the product, after it has left the active range of the roller, depends solely on friction that is present between the products and the belt conveyor. Since the products are in the active range of the roller for only a very short range of rotation, the reliability of the rotation is not reliable.

BRIEF SUMMARY OF THE INVENTION

It is therefore an object of the present invention to improve the known prior art apparatus in such a way that, with a simple construction, the reliability of the rotation of products in imbricated formation is insured. This object is achieved by means of a generic apparatus which has a belt conveyor along which an incoming imbricated formation of said product is transported along a conveying direction along the central axis of the product. A stop is arranged in the movement path of the product on one side relative to the central axis of the incoming imbricated formation. A roller is arranged to contact the product at a location on its other side relative to the central axis of the incoming imbricated formation of the product. The roller has an axis of rotation that extends approximately at right angles to the conveying direction of the belt conveyor and approximately tangent to the stop. The roller, together with the belt conveyor, forms a conveyor gap, and the products are located in this gap from the moment they strike the stop until the end of the rotary movement. The cooperation between the belt conveyor and the roller ensures that the products are positively driven, so that a reliably complete rotation of the products about the stop as the center of rotation, takes place. The roller may be driven at a circumferential speed which corresponds to the conveying speed of the belt conveyor. However, this is not necessary; and the roller may also be constructed as a freely-rotating weighted roller.

Particularly preferred embodiments of the apparatus of the invention permit groups of products that have been accumulated in imbricated formations and are separated by gaps to be rotated optionally in a simple way in one or the other directions.

Further preferred embodiments of the apparatus of the invention are defined in the dependent claims.

BRIEF DESCRIPTION OF SEVERAL VIEWS OF THE DRAWINGS

The invention will now be explained in more detail with reference to exemplary embodiments illustrated in the drawing.

DETAILED DESCRIPTION OF THE INVENTION

Figure 1:
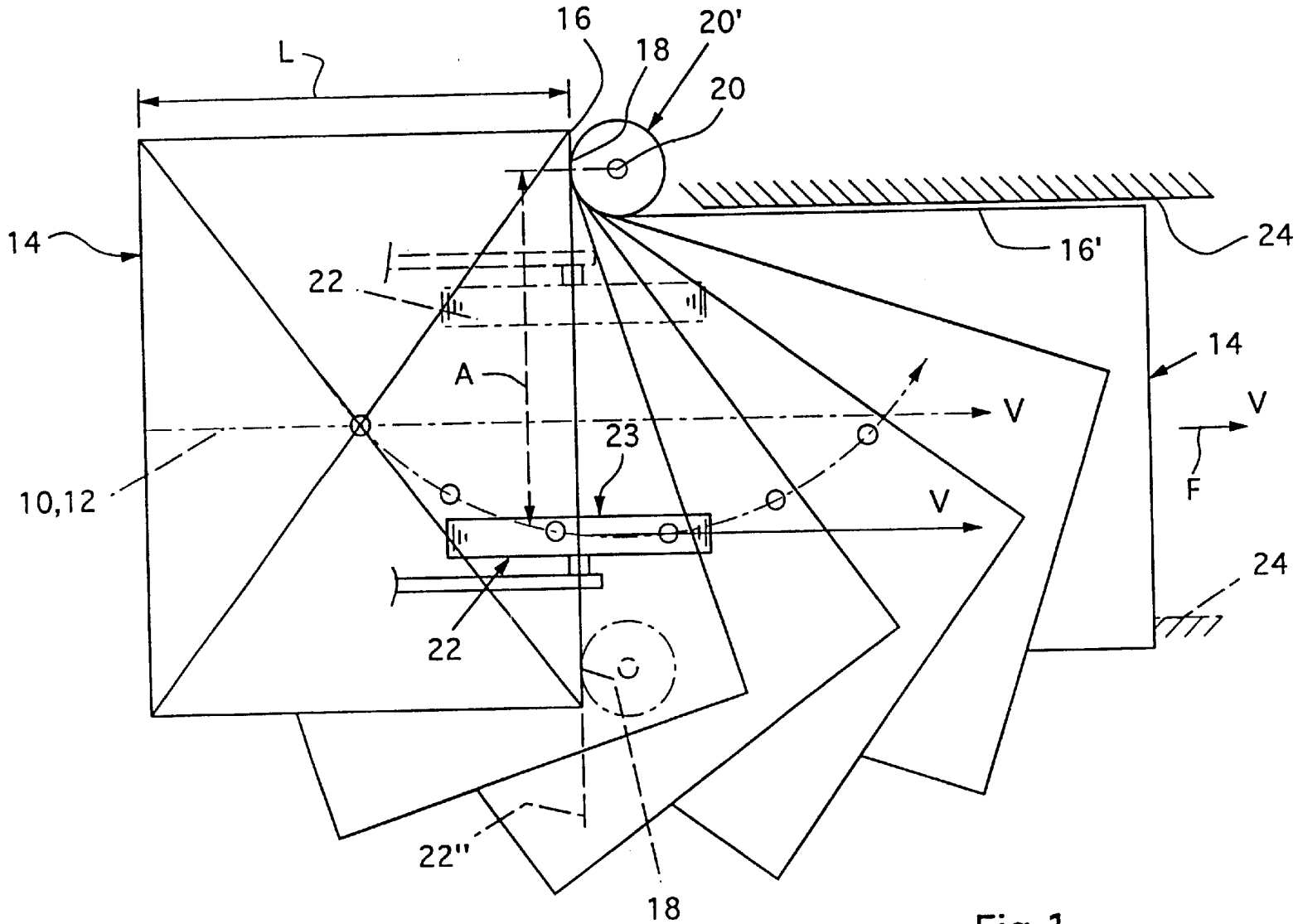
FIG. 1 shows in plan view a part of the device of the invention during the rotation of printing-works products.

In FIG. 1, a belt conveyor 10 that is driven at the speed v in the conveying direction F is indicated by a dash-dotted line. At the same time, this line also illustrates the central axis 12 of an imbricated formation, in which printing-works product 14 accumulate. From this imbricated formation, which is conveyed from the left and in which, as viewed in the conveying direction F, the printing-works product 14 rest in imbricated fashion on the respectively preceding printing-works product 14, only the foremost, completely visibly illustrated printing-works product 14 is shown, this product striking with a leading edge 16 and off-center against a stop 18.

The latter is formed by a stop roll 20', which has an axis 20 that runs at right angles to the conveying plane defined by the belt conveyor 10 and, for example, is mounted so that it can rotate freely or be driven. Viewed in the conveying direction F, the stop 18 is arranged on the left-hand side of the central axis 12 in such a way that the printing-works product 14 strike by way of the corresponding end region of the leading edge 16. Also illustrated in FIG. 1 underneath the completely visible printing-works product 14 are five additional partially visible printing-works product 14.

Each of these five partially visible views of the printing-works have a position that is rotated about the axis 20 in relation to the completely visible printing-works product 14.

There is located opposite to the stop 18, in relation to the central axis 12, on the right-hand side in the present example, a roller 22 that is arranged above the belt conveyor 10. Roller 22 is designed as a weighted roller, and its axis of rotation 22" runs parallel to the conveying plane, at right angles to the conveying direction F, and forms a tangent with the upstream side of the stop roll 20'.

Together with the belt conveyor 10, the freely rotatably mounted roller 22 forms a conveying gap 23, into which the respective printing-works product 14 runs virtually at the same time as it strikes the stop 18. The roller 22 ensures that the frictional force between the continuously driven belt conveyor 10 and the printing-works product 14 located in the conveying gap 23 is sufficiently high for that region of the printing-works product 14 which is located in the conveying gap 23 to be moved in the conveying direction F at the speed v of the belt conveyor 10. As a result, the printing-works product 14 that engaged stop 18 has rotated around the stop 18 as its center of rotation, until the printing-works product 14 comes to rest, with the previously leading edge 16 now forming the side edge 16'. Side edge 16' now engages a guide 24 which runs in the conveying direction F and, as viewed in the conveying direction F, is located downstream of the stop roll 20'. The operation of rotating the printing-works product as illustrated in FIG. 1 can be considered to show the same printing-works product 14 at six successive times or, six individual printing-works product 14 at the same time in a differently rotated positions. The distance A between the stop 18 and the roller 22 is selected such that the printing-works product 14 are kept in the conveying gap 23 between the roller 22 and the belt conveyor 10 during the entire rotation through 90°. In this illustrated embodiment, the distance A is smaller than the length L of the shorter edge of the rectangular printing-works product 14. In the exemplary embodiment illustrated, the mutual position of the roller 22 and of the stop 18 is adapted to the size of the printing-works product 14 in such a way that the center of gravity of the printing-works product 14 moves under the roller 22 during the rotation. The imbricated formation is conveyed at a constant speed v.

In another embodiment, the stop roll 20' could have a relatively large diameter. In such an embodiment, the distance A from the stop 18' to the roller 22' could be as large as or slightly larger than the length L of the shorter edge of the rectangular printing-works product 14.

In either of the above embodiments, the distance A from the roller 22, 22' to the stop 18, 18' may be smaller than the length L of the edges 16, 36 of the product 14.

As indicated by dash-dotted lines, in order to rotate the printing-works product 14 in the opposite direction of rotation, to the right in the present case, the stop 18 can be arranged on the right-hand side of the central axis 12 and the roller 22 on the left-hand side of the central axis 12. Accordingly, the guide 24 would then also have to be provided on the right-hand side of the central axis 12.

Figure 2:
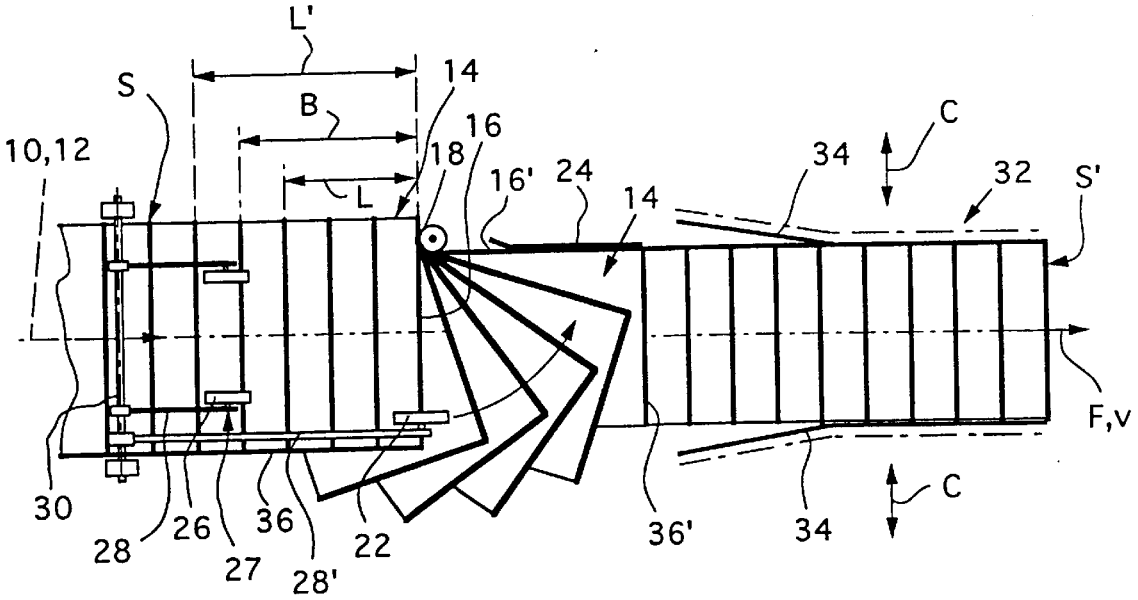
FIG. 2 shows in plan view an embodiment of the device of the invention for rotating the products to the left.

As can be gathered from FIG. 2, the apparatus shown in FIG. 1 has a pair of pressure rollers 26 upstream of the stop 18. This pair of pressure rollers form a conveying gap 27 with the belt conveyor 10. The pressure rollers are each freely rotatably mounted at the free end of a lever 28 which, for its part, is freely pivotably mounted by way of its other end on a bearing axis 30, which is arranged parallel to the conveying plane and runs at right angles to the conveying direction F above the belt conveyor 10. The pair of pressure rollers 26 are at a distance B from the stop 18 measured in the conveying direction F, which is greater than the dimension L of the printing-works product 14. However, the distance B is preferably smaller than the joint length L', as measured in the conveying direction F, of two adjacent printing-works product 14 lying on each other in imbricated fashion in the incoming imbricated stream S. Length L' corresponds to the distance between the leading edge of the first printing-works product 14 and the trailing edge of the second following printing-works product 14. As a result of the distance B being selected in this way, the pair of pressure rollers 26 presses the printing-works product 14 which directly follows that printing-works product 14 strike the stop 18 in order to be rotated in friction contact against the belt conveyor 10 so that it is not carried along by the preceding printing-works product 14.

As can also be seen in FIG. 2, the roller 22 is freely rotatably mounted at the free end of a lever 28', which is likewise freely pivotably mounted on the bearing axle 30.

As viewed in the conveying direction F downstream of the guide 24 which adjoins the stop 18, there is arranged a side alignment arrangement 32. This has strip-like side alignment elements 34, which are driven to and fro in opposite directions synchronously in the direction of the double arrow C, in order to be moved from an outer position, indicated by dash-dotted lines, toward one another into an alignment position in which their spacing corresponds approximately to the width of the printing-works product 14 in the imbricated formation S', and back again. During movement into the alignment position, the side alignment elements 34 press any laterally offset printing-works product 14 into a position that is symmetrical in relation to the central axis 12 with the result that, downstream of the side alignment arrangement 32, the side edges 16' of all the printing-works product 14 are aligned and run in the conveying direction F.

In the accumulating imbricated formation, denoted by S, each printing-works product 14 lies in imbricated fashion on the respectively preceding printing-works product 14, and the distance between the leading edges 16 of adjacent printing-works product 14 is essentially constant. The foremost printing-works product 14 of the imbricated formation S in each case strikes the stop 18 with its leading edge 16 and is then, by means of the roller 22, held with a frictional connection above the preceding and already further-rotated printing-works product 14 on the belt conveyor 10. As a result of the continuous rotation of successive printing-works product 14 in the rotational area, these assume a mutually fan-like position without the overlapping of successive printing-works products being canceled. After being rotated completely to the left, during which the previously leading edge 16 is now the side edge 16', the printing-works product 14 is conveyed away by means of the belt conveyor 10 in an imbricated formation S', in which the preceding right side edge 36 is now the leading edge 36'. Since the rotating of successive printing-works product 14 is carried out continuously and under the same conditions for all printing-works product 14, the distance between the leading edges 36' of successive printing-works product 14 in the imbricated formation S' that is formed by rotation downstream of the stop 18 is the same size as in the accumulating imbricated formation S.

Figure 3:
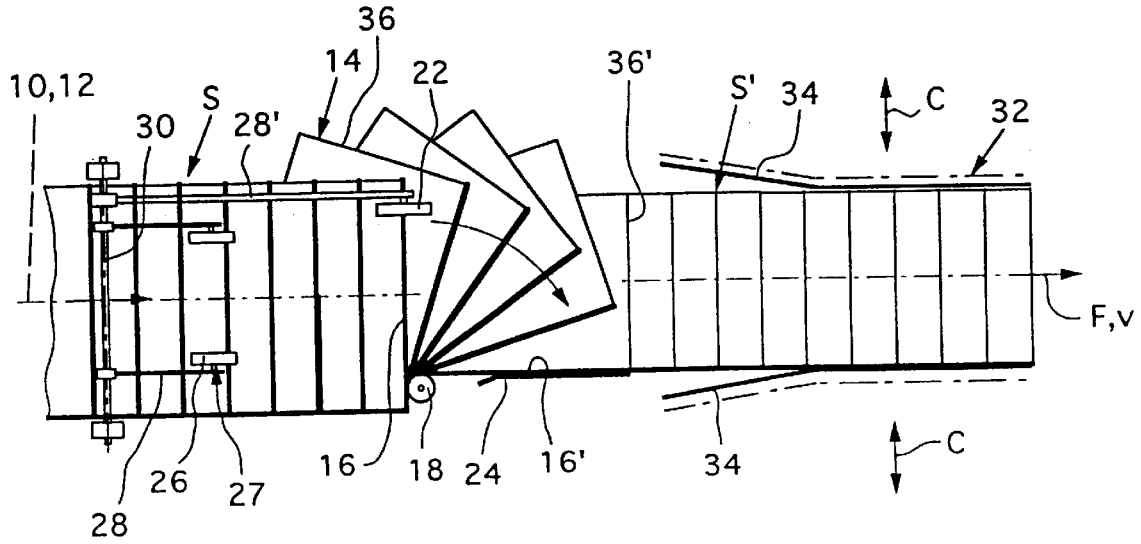
FIG. 3 shows in plan view an embodiment of the apparatus of the invention for rotating the products to the right.

The embodiment of the apparatus of the invention that is shown in FIG. 3 is of mirror-image construction in relation to the embodiment shown in FIG. 2. As a result, the printing-works product 14 of the accumulating imbricated formation S is rotated in the opposite direction in relation to the embodiment shown in FIGS. 1 and 2. That is to say in the clockwise direction in the present case. Otherwise, the mode of operation is exactly the same as in the embodiment shown in FIG. 2. The reference numbers used in FIG. 3 are the same as used in FIG. 2, with the exception of the side edge 36, which lies on the left of the delivery stream.

Figure 4:
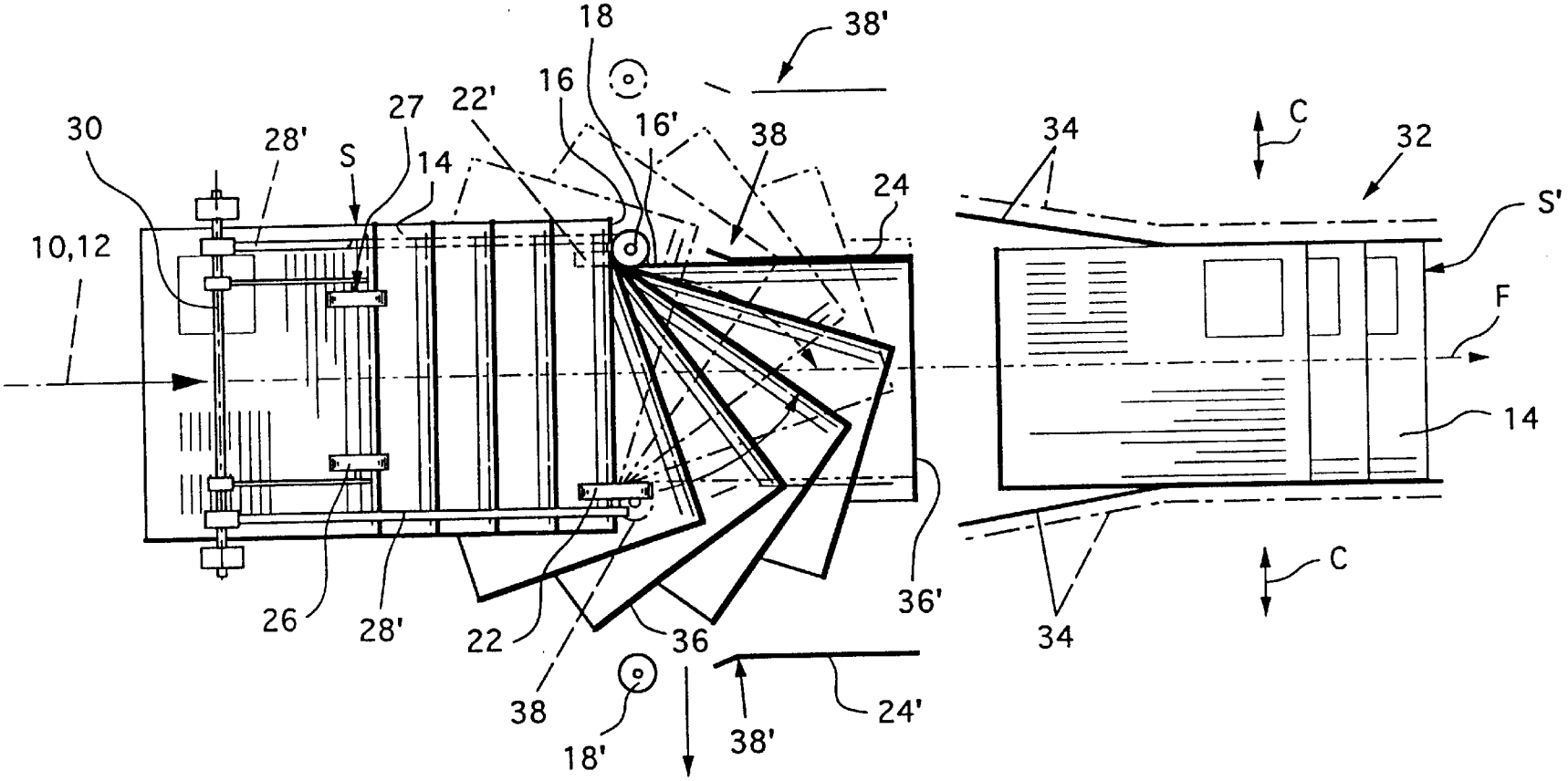
FIG. 4 shows an embodiment of the apparatus of the invention for rotating the products of an imbricated formation optionally to the left or right, having two stops that can be changed over and are arranged alongside each other.

FIG. 4 shows a first embodiment of the invention in which the printing-works product 14 accumulating in the imbricated formation can be rotated optionally in one or the other directions. For this purpose, the apparatus has stops 18, 18' with associated guides 24, 24' on both sides of the central axis 12, and rollers 22, 22' that are in each case arranged on opposite sides of the central axis 12. The stop 18 arranged to the left of the central axis 12, as viewed in the conveying direction F, and the associated guide 24 are drawn with emphasized lines in an operating position 38. The stop 18 and the guide 24 can be moved by conventional known drive arrangements, for example, a piston/cylinder unit, into a rest position that is indicated with a dash-dotted line and designated by 38', in which it is located outside the movement path of the printing-works product 14 of the incoming imbricated formation S. In a corresponding way, the associated roller 22 can be lifted, for example, likewise by means of a piston/cylinder unit, around the bearing axis 30 from its operating position, in which it comes to rest on the printing-works product 14 , into a rest position, in which it is spaced apart from the printing-works product 14. In the setting shown in FIG. 4 of the apparatus for rotating the printing-works product 14 in the counterclockwise direction, the stop 18' with the guide 24' and the associated roller 22', are located in the rest position 38', which is illustrated as emphasized lines. In order to rotate the printing-works product 14 in the clockwise direction, this stop 18' with the guide 24' and the roller 22' are brought into the operating position 38, indicated by dash-dotted lines. The other stop 18 with guide 24 and roller 22 are simultaneously changed over into the rest position 38'. The rotation of the printing-works product 14 of the incoming imbricated formation S in the counterclockwise direction is indicated by emphasized lines, and the rotation in the clockwise direction by dash-dotted lines. Downstream of the stop 18, 18' and of the guide 24, 24', there is once more arranged a side alignment arrangement 32.

The stops 18, 18', guides 24, 24' and rollers 22, 22' are changed over from the operating position 38 into the rest position 38', or rest position 38' into operating position 38 in order to change the direction of rotation, in each case in a gap between two successive imbricated formations S. As seen in FIG. 4, the printing-works product 14 located in the side alignment arrangement 32 has been rotated in the clockwise direction, whereas the printing-works product 14 now being fed in a following imbricated formation S is rotated in the counterclockwise direction.

Figure 5:
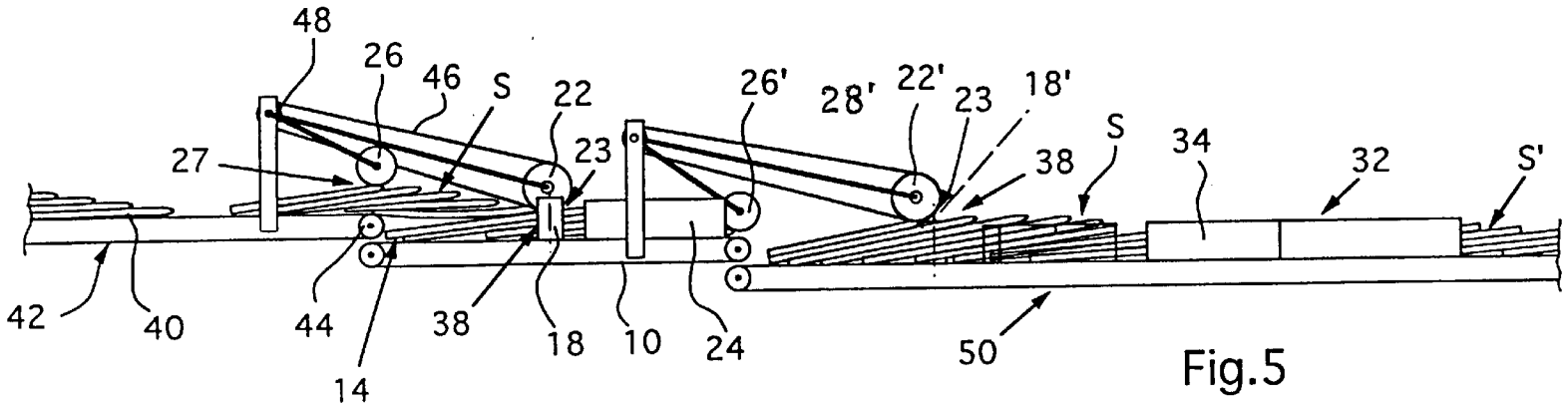
FIG. 5 shows in front view a further embodiment of the apparatus of the invention for rotating products accumulating in imbricated formations optionally to the left or right, having controlled stops that are spaced apart from one another in the conveying direction.
Figure 6:
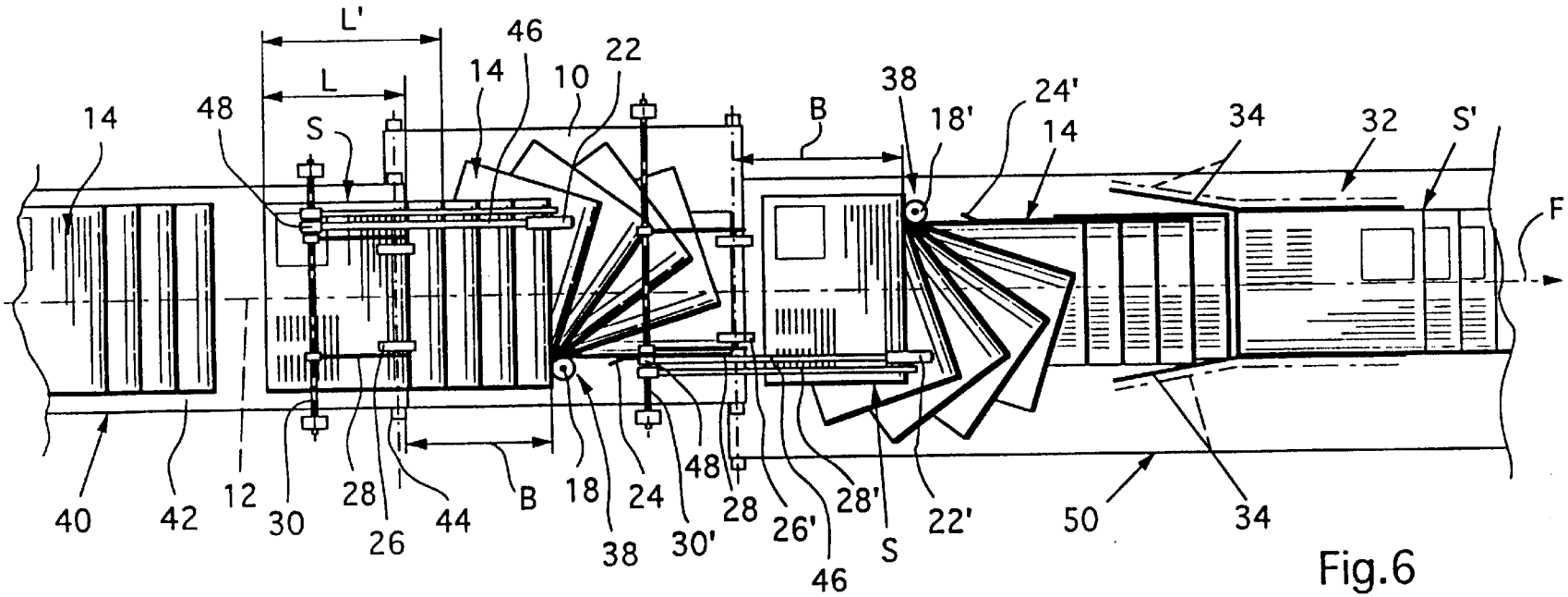
FIG. 6 shows in plan view the embodiment of the apparatus of the invention shown in FIG. 5.

The embodiment of the apparatus of the invention that is shown in FIGS. 5 and 6 likewise offers the possibility of optionally rotating the printing-works product 14 accumulating in an imbricated formation S in the clockwise or in the counterclockwise direction. Connected upstream of the belt conveyor 10, which is assigned to the first stop 18, is a feed conveyor 40 likewise constructed as a belt conveyor. As viewed in the conveying direction F, the feed conveyor 40 ends above the start of the belt conveyor 10 so that, viewed in the conveying direction F, a falling step is formed from the feed conveyor 40 to the belt conveyor 10. At its downstream end, the conveyor belt 42 of the feed conveyor 40 is guided in a known way around a turn roll 44. Located above this turn roll 44 is a pair of pressure rollers 26, whose rollers are once more freely pivotably arranged via a lever 28 each on the bearing axle 30. The pair of pressure rollers 26, together with the conveyor belt 42 led around the turn roll 44, form a conveying gap 27 for the printing-works product 14 that is to be fed to the belt conveyor 10 and accumulate in the imbricated formation S. The distance B, measured in the conveying direction F between the end of the feed conveyor 40 and the stop 18, is greater than the length L measured in the conveying direction F of the accumulating printing-works product 14, but preferably smaller than the joint length L' of two adjacent successive printing-works products 14. As a result of this measure, the printing-works product 14 striking the stop 18 has run off the feed conveyor 40, whereas the following printing-works product 14 is still held in the conveying gap 27. Because of the step, the printing-works product 14 striking the stop 18 is thus free at its trailing end region (FIG. 5) as a result of which friction with the following printing-works product 14 is canceled or is very low, which ensures reliable and safe rotation of the printing-works product 14. A guide belt 46 is led around the roller 22 that is assigned to the stop 18 and also around a roll 48 mounted on the bearing axle 30 from which it can be driven. Guide belt 46 is on the other side of central axis 12 relative to roll 18. This ensures that none of the printing-works product 14 can jump over the stop 18 that is located in the operating position 38. In a manner similar to that shown in FIG. 4, stop 18 can be shifted from the operating position 38 into a rest position 38', in which it is located outside the movement path of the printing-works product 14.

Connected downstream of the belt conveyor 10 is a second belt conveyor 50. Belt conveyor 10 forms a falling step in relation to the second belt conveyor 50 in the same way as between the feed conveyor 40 and the belt conveyor 10. Located downstream of the belt conveyor 10, at the distance B, is a second stop 18', which is assigned to the second belt conveyor 50 and is located on the side opposite the stop 18 in relation to the central axis 12. Located on the same side as the stop 18 is a roller 22' which is assigned to the second stop 18'. The roller 22' is pivotably mounted via a lever 28' on a second bearing axle 30'. A second pair of pressure rollers 26' is arranged via second levers 28 which are also carried on second bearing axle 30'. This pair of pressure rollers cooperates with the belt conveyor 10 at its downstream end. Connected downstream of the stop 18' with the associated guide 24' is the side alignment arrangement 32.

At the point in time shown in FIGS. 5 and 6, both stops 18, 18' are in the operating position 38. The printing-works product 14 fed in the imbricated formation S to the upstream stop 18 is rotated in the clockwise direction. In a corresponding way, the printing-works product 14 arranged in a preceding imbricated formation S has been or is being rotated by means of the stop 18' in the counterclockwise direction, as shown in FIGS. 1 and 2. As soon as the last printing-works product 14 assigned to this imbricated formation S has been rotated, the stop 18' is brought into the rest position 38', in order, by means of the second belt conveyor 50, to feed the printing-works product 14 which have been rotated by means of the upstream stop 18 to the side alignment arrangement 32 without exerting any influence on them, and then to convey them away. Depending on whether the printing-works product 14 assigned to the next following imbricated formation then has to be rotated in the clockwise or in the counterclockwise direction, the appropriate stop 18, 18' is then brought into the operating position 38 or rest position 38'. Of course this is done together with the associated guide 24, 24', but now the rollers 22, 22' can always remain in the operating position.

Figure 7:
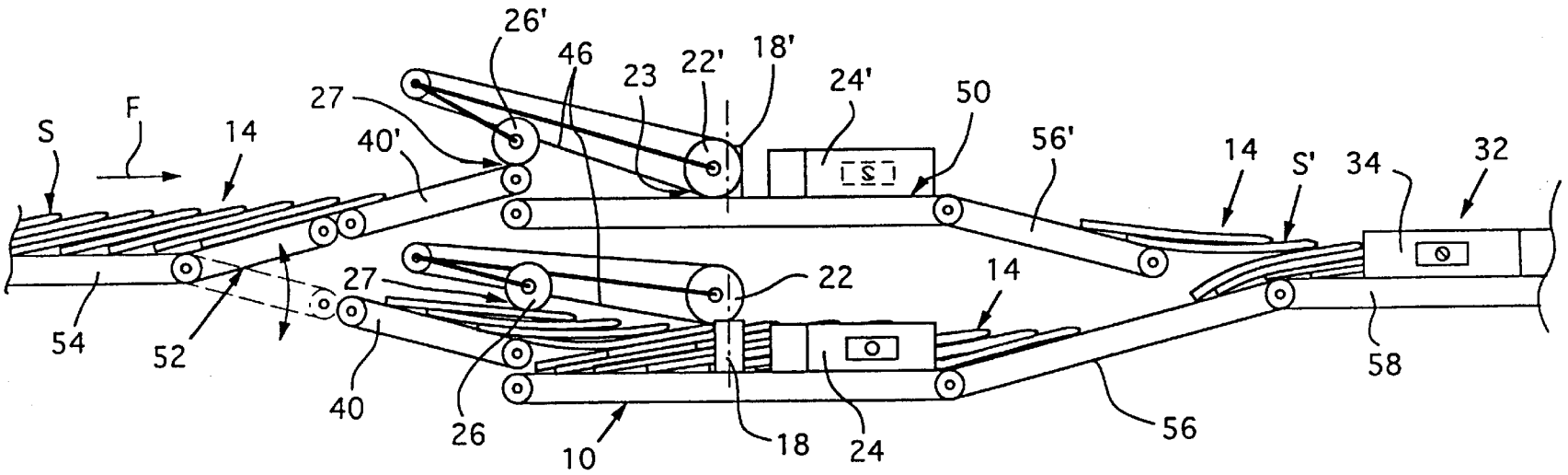
FIG. 7 shows in front view a further embodiment of the apparatus of the invention for rotating the products accumulating in imbricated formations optionally to the left or right, having stops arranged one above another.

In the case of the apparatus of the invention shown in FIG. 7, the belt conveyor 10 and the second belt conveyor 50 are arranged one above another. Each of these belt conveyors 10, 50 is assigned a feed conveyor 40, 40', likewise constructed as a belt conveyor, whose downstream end, as viewed in the conveying direction F, once more ends above the belt conveyors 10, 50. Positioned upstream of the two feed conveyors 40, 40' is a rocker 52, constructed as a belt conveyor, which can be changed over to and fro between the two belt conveyors 10 and 50, in order that the printing-works product 14 fed in imbricated formation S by an upstream belt-conveyor 54, can be led optionally to the belt conveyor 10 or the second belt conveyor 50.

Viewed in the conveying direction F, the belt conveyor 10 has assigned to it the stop 18 with the guide 24 on the right-hand side in relation to the central axis 12, and the roller 22 on the left-hand side. Correspondingly diametrically opposite, in the region of the second belt conveyor 50, the stop 18' with the guide 24' is arranged on the left-hand side in relation to the central axis 12, and the roller 22' is arranged on the right-hand side. Furthermore, a pair of pressure rollers 26, 26' cooperate with each of the feed conveyors 40, 40', as was previously show in FIGS. 5 and 6. In this embodiment, both pairs of pressure rollers 26, 26', the stops 18, 18' and guides 24, 24' are located in the operating position 38, and do not need to be constructed so that they can be changed over into a rest position.

Connected downstream of the belt conveyor 10 is a discharge conveyor 56, which is constructed as a belt conveyor and has a rise, which is followed by a discharge conveyor belt 58 to which the side alignment arrangement 32 is assigned. Connected downstream of the second belt conveyor 50 there is likewise a discharge conveyor 56', that is shorter in length than the discharge conveyor 56 and terminates above the latter.

FIG. 7 shows, in the right-hand end region, an imbricated formation S', whose printing-works product 14 has previously been rotated to the left, as seen in the conveying direction, by means of the second belt conveyor 50 and the associated stop 18'. When leaving the discharge conveyor 56', these printing-works products fall onto the discharge conveyor 56 or the discharge conveyor belt 58. In the region of the feed conveyor 40 of the belt conveyor 10, and in the initial section of the discharge conveyor 56, there is another imbricated formation S, whose printing-works product 14 has been rotated or is still being rotated to the right, as viewed in the conveying direction, by means of the stop 18 assigned to the belt conveyor 10. This imbricated formation S, following the imbricated formation S' with a gap, is fed by means of the discharge conveyor 56 to the discharge conveyor belt 58 and the side alignment arrangement 32. The discharge conveyor 56' ends at a distance above the belt conveyor 56 such that the printing-works product 14 rotated on the belt conveyor 10 can be conveyed through. The rocker 52 is pivoted in the upward direction, in order to feed a further accumulating imbricated formation S to the second belt conveyor 50, where the relevant printing-works product 14 are then rotated to the left through 90°.

It can be seen from FIG. 7 that if the rocker 52 is respectively changed over following the feeding of each imbricated formation, the corresponding printing-works product 14 is rotated either to the left or to the right. If the rotation of the printing-works product 14 of successive imbricated formations S in only one direction is desired, the rocker 52 is kept in the relevant position.

FIGS. 8 to 14 show a further embodiment of the apparatus of the invention for the optional rotation of the printing-works product 14 accumulating in an imbricated formation S to the left or the right. Two circulating systems 60, 60' are arranged opposite each other in relation to the belt conveyor 10. Each circulating system has an intrinsically closed carrying element 62, configured, for example, as a carrying belt 62, which is guided around four turn rollers 64, 66, 68 and 70 arranged in a rectangle. The run 72 of the carrying belt 62 which, in each case faces the belt conveyor 10, forms a guide section 72' and runs from the corresponding turn roller 64 to the downstream turn roller 66, is parallel to the belt conveyor 10 and to the central axis 12. Arranged in the manner of a curtain on each carrying belt 62 is a stopping and guiding element 74, 74' which, measured in the longitudinal direction of the carrying belt 62, is shorter than half the length of the carrying belt 62 but longer than the guide section 72'. As measured at right angles to the conveying direction F, the belt conveyor 10 has a smaller width than the printing-works product 14 of the imbricated formation fed. Arranged on both sides of the belt conveyor 10 is a supporting plate 76, down to which the stopping and guiding element 74, 74' reaches, at least approximately. The carrying belts 62 of the two circulating systems 60, 60' are driven in synchronism with each other but with a phase shift of 180°. The distance of the runs 72 of the two circulating systems 60, 60', measured at right angles to the conveying direction F, corresponds at least approximately to the length L of the shorter edge of the printing-works product 14 in the accumulating imbricated formation S, in which this shorter side edge runs in the conveying direction F.

Assigned to each of the turn rollers 64, on the other side in relation to the central axis 12, is a roller 22 and 22', which can be changed over from an operating position into a rest position. A pair of pressure rollers 26 is connected upstream of the turn rollers 64 at a distance B which is once more greater than the length L of the edge of the fed printing-works product 14, but preferably shorter than the joint length, measured in the conveying direction F, of two successive printing-works product 14.

Figure 8:
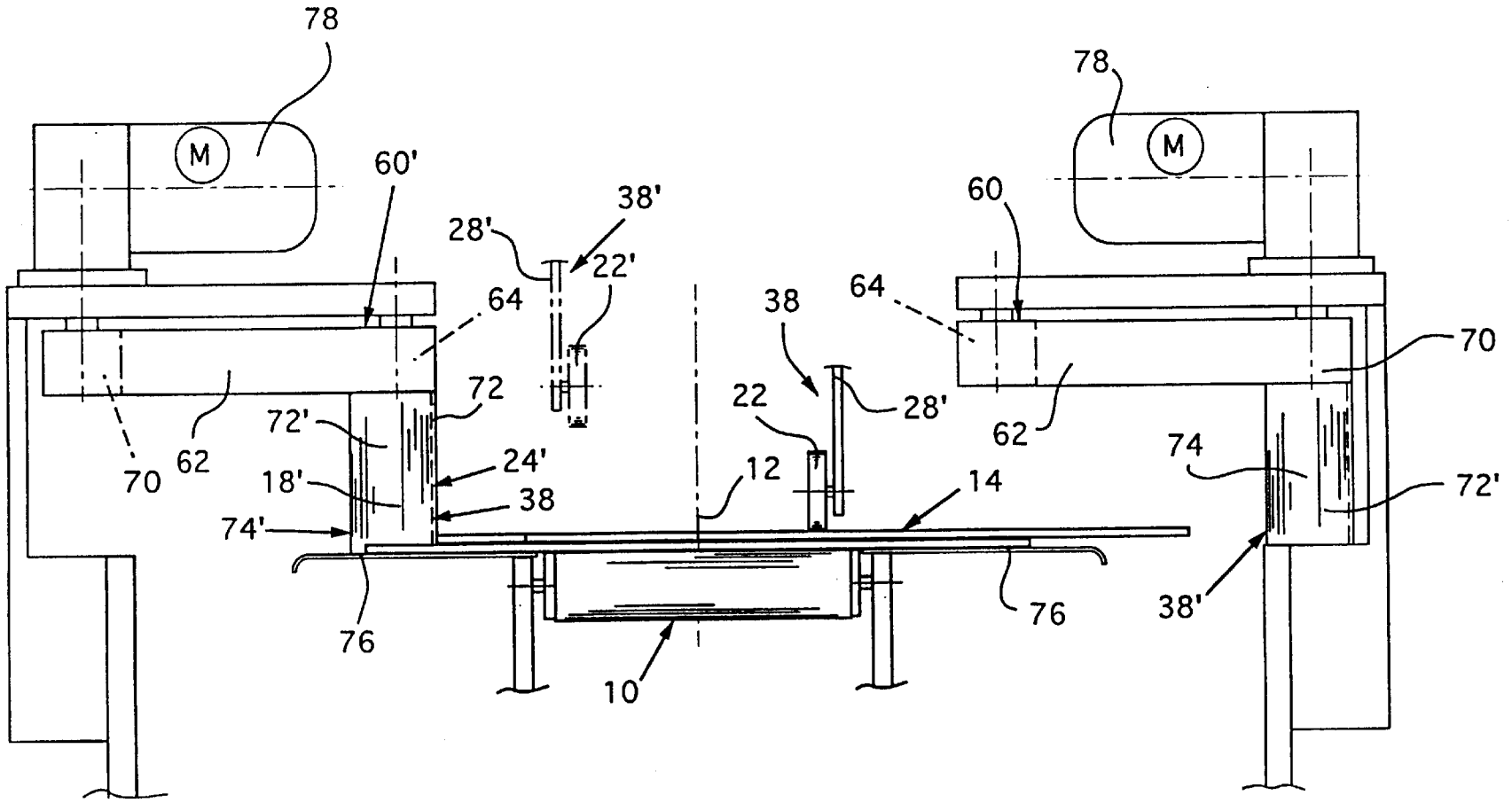
FIG. 8 shows in side view a further embodiment of the apparatus of the invention for rotating the products accumulating in imbricated formations optionally to the left or right, having symmetrically arranged circulating systems for a stopping and guiding element.

In FIG. 8, the stopping and guiding element 74' that is arranged on the left in relation to the belt conveyor 10 and the central axis 12 is located in the operating position 38, and the opposite stopping and guiding element 74 is located in the rest position 38'. In a corresponding way, the roller 22 is located in the operating position 38, and the roller 22' (indicated by dash-dotted lines) is in the rest position 38', in which it is lifted off the printing-works product 14. Drive motors 78 that include reduction gear mechanisms are provided for driving the circulating systems 60, 60'.

Figure 9:
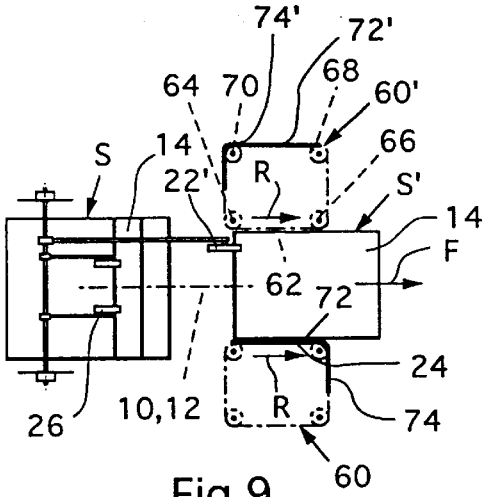
FIGS. 9 to 14 show in plan view the embodiment shown in FIG. 8 of the apparatus of the invention at different points in time when changing over from one direction of rotation to the other, and rotation of the products accumulating in an imbricated formation.

The function of the embodiment illustrated in FIG. 8 will now be explained with reference to FIGS. 9 to 14. In FIG. 9, a printing-works product 14 is shown between the two circulating systems 60, 60', this product being the last of an imbricated formation S' whose printing-works product 14 has been rotated through 90° in the clockwise direction. The two circulating systems 60, 60' are driven in opposite directions in the direction of the arrows R, so that the trailing end of the stopping and guiding element 74 on the right in relation to the center line 12 moves in the conveying direction F, approximately with the trailing end of the printing-works product 14.

Figure 10:
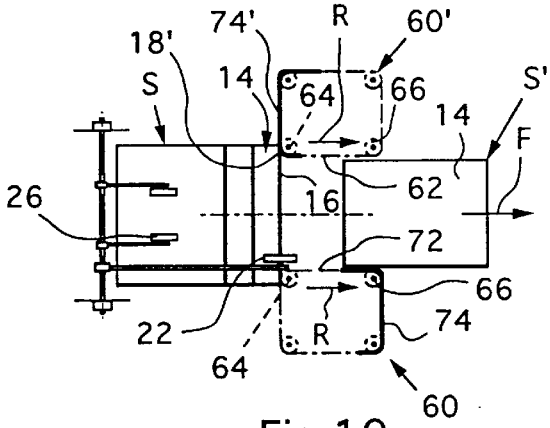

This printing-works product 14 is followed at a distance by an accumulating imbricated formation S, whose printing-works product 14 is to be rotated in the counterclockwise direction. To this end, as FIG. 10 shows, the driving of the circulating systems 60, 60' means that the stopping and guiding element 74' of the left-hand circulating system 60' (as viewed in the conveying direction F) moves around the corresponding turn roller 64, where it forms the stop 18'. The fed printing-works product 14 strikes stop 18' off-center. In FIG. 10, this is shown using the first printing-works product 14 of the accumulating imbricated formation S, as viewed in the conveying direction.

Figure 11:
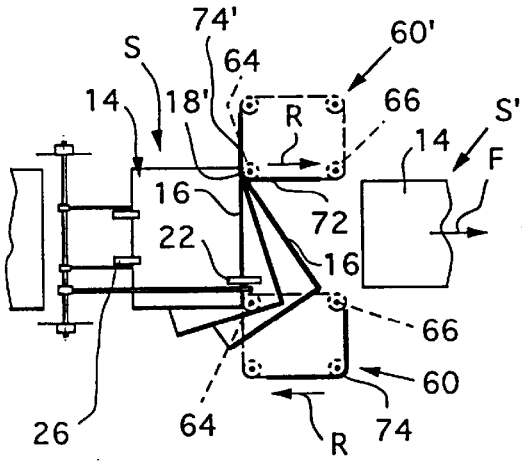
Figure 12:
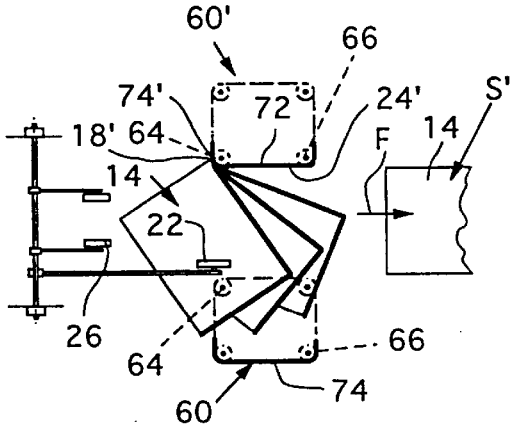

At the point in time shown in FIG. 11, two printing-works products 14 of the imbricated formation S have already been partially rotated in the counterclockwise direction, and the third printing-works product 14 is striking the stopping and guiding element 74'. Since, at this point in time, the stopping and guiding element 74 of the circulating system 60 that is arranged on the right, as viewed in the conveying direction, has moved outside the run 72, the printing-works product 14 to be rotated is able to move through underneath the turn rollers 64 and 66, as is also shown in FIG. 12. The circulating systems 60, 60' are driven until the stopping and guiding element 74' assigned to the left-hand circulating system 60' is located symmetrically with respect to the run 72 and still engages around the turn roller 64. The circulating systems 60, 60' are stopped in this position. The rollers 22 and 22' prevent the printing-works product 14 from moving away transversely with respect to the conveying direction F when the stopping and guiding element 74, 74' is driven.

Figure 13:
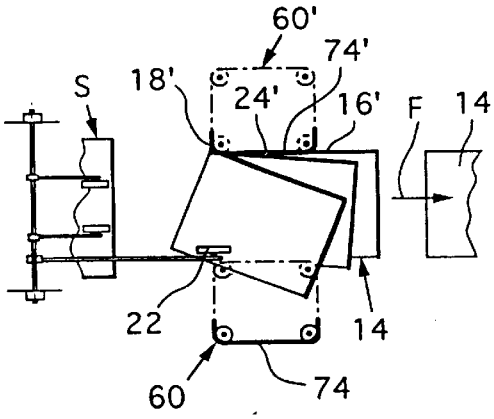

As also emerges from FIG. 13, the appropriate run 72 of the stopping and guiding element 74, 74', in addition to forming the stop 18, 18', also forms the guide 24 and 24', which the rotated printing-works product 14 strikes with its edge 16', which is now arranged at the side.

Figure 14:
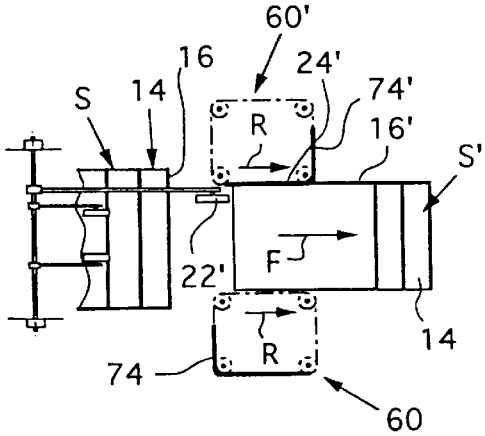

Once the last printing-works product 14 of an accumulating imbricated formation S has been rotated, the circulating systems 60, 60' are driven again so that the previously active stopping and guiding element 74' is now brought into a rest position 38', and the stopping and guiding element 74 assigned to the other circulating system 60 is brought into the operating position 38. As previously described, the printing-works product 14 of the following accumulating imbricated formation S will now be rotated in the clockwise direction. For this purpose, the previously active roller 22 is lifted into the rest position and the roller 22' is lowered in the operating position, as indicated in FIG. 14.

The apparatus of the invention is suitable not only for processing printing-works product 14, but in general for rotating rectangular flat products accumulating in an imbricated formation. These may, for example, also be samples of goods or the like.

In the examples shown, the products in the accumulating imbricated formation S assume a position in which the longer side edge runs at right angles to the conveying direction and the shorter runs in the conveying direction F. However, it is possible to use the apparatus of the invention also to rotate products of an imbricated formation whose longer "side edge" runs in the conveying direction F.

In the case of each of the embodiments shown, it is advantageous to connect upstream of the relevant belt conveyor 10 or 50 a feed conveyor 40, 40' which ends above the belt conveyor, in order to form a falling step for the product 14 to be rotated.

It is also possible for the belt conveyors 10, 50 and feed conveyors 40, 40' to be driven at different speeds, in order to reduce or enlarge the distance between the leading edges of successive printing-works products.

It is also possible to drive the guiding elements 74, 74' individually in a controlled manner using the drive motor 78. In addition, it is possible to use only one circulating system 60, 60', it then being necessary for the guiding elements 74, 74' to be closed, as is illustrated in similar fashion in FIG. 2 and FIG. 3.

What is claimed is:

1. An apparatus for rotating rectangular flat products that have been accumulated in an imbricated formation, in particular printing-works products, comprising:

a belt conveyor along which an incoming imbricated formation of said product are transported in a conveying direction along the central axis of said product;

a stop arranged in the movement path of said products on one side in relation to the central axis of the incoming imbricated formation;

a roller arranged to contact said products at a location on its other side in relation to the central axis of the incoming imbricated formation of the product, said roller having an axis of rotation extending at approximately right angles to the conveying direction of the belt conveyor and approximately tangent to said stop.

2. The apparatus as claimed in claim 1, further comprising:

a feed conveyor, in the form of a belt conveyor having a discharge end, provided upstream of the belt conveyor and, as viewed in the conveying direction, has its discharge end above the belt conveyor at a predetermined distance upstream of the stop, said predetermined distance being at least equally to or greater than the length of said product, measured in the conveying direction and less than the joint length, measured in the conveying direction, of respectively two adjacent products lying on each other in imbricated fashion in the incoming imbricated formation.

3. The apparatus as claimed in claim 1 further comprising:

a pressure roller, which forms a conveying gap with said belt conveyor, said pressure roller located a predetermined distance upstream of said stop, said predetermined distance being at least equally to the length, measured in the conveying direction of the products in the incoming imbricated formation and less than the joint length, as measured in the conveying direction, of respectively two adjacent products lying on each other in imbricated fashion in the incoming imbricated formation.

4. The apparatus as claimed in claim 2 further comprising:

a pressure roller, which forms a conveying gap with said feed conveyor, said pressure roller located a predetermined distance upstream of said stop, said predetermined distance being at least equally to the length, measured in the conveying direction, of the products in the incoming imbricated formation and less than the joint length, as measured in the conveying direction, of respectively two adjacent products lying on each other in imbricated fashion in the incoming imbricated formation.

5. The apparatus as claimed in claim 1 further comprising:

a second belt conveyor arranged above said belt conveyor;

a diverter mechanism located upstream of said belt conveyors that can be changed over to alternately to feed an imbricated formation to either belt conveyor; and said second belt conveyor is provided a stop and a roller, which are arranged diametrically opposite in relation to said stop and said roller of said belt conveyor.

6. The apparatus as claimed in claim 2 further comprising:

a second belt conveyor arranged above said belt conveyor;

a diverter mechanism located upstream of said belt conveyors that can be changed over to alternately to feed an imbricated formation to either belt conveyor; and said second belt conveyor is provided a stop and a roller, which are arranged diametrically opposite in relation to said stop and said roller of said belt conveyor.

7. The apparatus as claimed in claim 3 further comprising:

a second belt conveyor arranged above said belt conveyor;

a diverter mechanism located upstream of said belt conveyors that can be changed over to alternately to feed an imbricated formation to either belt conveyor; and said second belt conveyor is provided a stop and a roller, which are arranged diametrically opposite in relation to said stop and said roller of said belt conveyor.

8. The apparatus as claimed in claim 4 further comprising:

a second belt conveyor arranged above said belt conveyor;

a diverter mechanism located upstream of said belt conveyors that can be changed over to alternately to feed an imbricated formation to either belt conveyor; and said second belt conveyor is provided a stop and a roller, which are arranged diametrically opposite in relation to said stop and said roller of said belt conveyor.

9. The apparatus as claimed in claim 1 further comprising:

said stop comprising a stop roll that is mounted for free rotation about an axis extending at right angles to the conveying plane of said belt conveyor;

a guide located downstream of said stop against which a side edge of the rotated products come to rest.

10. The apparatus as claimed in claim 2 further comprising:

said stop comprising a stop roll that is mounted for free rotation about an axis extending at right angles to the conveying plane of said belt conveyor;

a guide located downstream of said stop against which a side edge of the rotated products come to rest.

11. The apparatus as claimed in claim 3 further comprising:

said stop comprising a stop roll that is mounted for free rotation about an axis extending at right angles to the conveying plane of said belt conveyor;

a guide located downstream of said stop against which a side edge of the rotated products come to rest.

12. The apparatus as claimed in claim 4 further comprising:

said stops each comprising a stop roll that is mounted for free rotation about an axis extending at right angles to the conveying plane of said belt conveyor;

guides located downstream of said stops against which side edges of the rotated products come to rest, and said guides can be changed over between the operating position and rest position.

13. The apparatus as claimed in claim 1 further comprising:

said roller being driven.

14. The apparatus as claimed in claim 1 further comprising:

said stop comprising a stop roll being driven about an axis extending at right angles to the conveying plane of said belt conveyor.

15. The apparatus as claimed in claim 1 further comprising:

said roller being provided with a guide belt that extends in the conveying direction.

16. The apparatus as claimed in claim 2 further comprising:

said roller being provided with a guide belt that extends in the conveying direction.

17. The apparatus as claimed in claim 3 further comprising:

said roller being provided with a guide belt that extends in the conveying direction.

18. The apparatus as claimed in claim 4 further comprising:

said roller being provided with a guide belt that extends in the conveying direction.

19. The apparatus as claimed in claim 1 wherein the improvement further comprises:

a stop and a roller are arranged on each side of the central axis, a stop together with a roller respectively arranged on the opposite side of the central axis being in an operating position while the other stop together with the other roller on the other side of the central axis are in a rest position and the stops and rollers can be changed over, preferably in opposite phase, between the operating position and the rest position.

20. The apparatus as claimed in claim 2 wherein the improvement further comprises:

a stop and a roller are arranged on each side of the central axis, a stop together with a roller respectively arranged on the opposite side of the central axis being in an operating position while the other stop together with the other roller on the other side of the central axis are in a rest position and the stops and rollers can be changed over, preferably in opposite phase, between the operating position and the rest position.

21. The apparatus as claimed in claim 3 wherein the improvement further comprises:

a stop and a roller are arranged on each side of the central axis, a stop together with a roller respectively arranged on the opposite side of the central axis being in an operating position while the other stop together with the other roller on the other side of the central axis are in a rest position and the stops and rollers can be changed over, preferably in opposite phase, between the operating position and the rest position.

22. The apparatus as claimed in claim 4 wherein the improvement further comprises:

a stop and a roller are arranged on each side of the central axis, a stop together with a roller respectively arranged on the opposite side of the central axis being in an operating position while the other stop together with the other roller on the other side of the central axis are in a rest position and the stops and rollers can be changed over, preferably in opposite phase, between the operating position and the rest position.

23. The apparatus as claimed in claim 1 wherein the improvement further comprises:

a second stop and a second roller downstream of said stop and said roller, diametrically opposite in relation to the central axis, and wherein said stops can be changed over, preferably in opposite phase, between an operating position and a rest position.

24. The apparatus as claimed in claim 2 wherein the improvement further comprises:

a second stop and a second roller downstream of said stop and said roller, diametrically opposite in relation to the central axis, and wherein said stops can be changed over, preferably in opposite phase, between an operating position and a rest position.

25. The apparatus as claimed in claim 3 wherein the improvement further comprises:

a second stop and a second roller downstream of said stop and said roller, diametrically opposite in relation to the central axis, and wherein said stops can be changed over, preferably in opposite phase, between an operating position and a rest position.

26. The apparatus as claimed in claim 4 wherein the improvement further comprises:

a second stop and a second roller downstream of said stop and said roller, diametrically opposite in relation to the central axis, and wherein said stops can be changed over, preferably in opposite phase, between an operating position and a rest position.

27. The apparatus as claimed in claim 19 wherein the improvement further comprises:

said stop comprising a stop roll that is mounted for free rotation about an axis extending at right angles to the conveying plane of said belt conveyor;

guides located downstream of said stops against which side edges of the rotated products come to rest, and said guides can be changed over between the operating position and rest position.

28. The apparatus as claimed in claim 20 wherein the improvement further comprises:

said stop comprising a stop roll that is mounted for free rotation about an axis extending at right angles to the conveying plane of said belt conveyor;

guides located downstream of said stops against which side edges of the rotated products come to rest, and said guides can be changed over between the operating position and rest position.

29. The apparatus as claimed in claim 23, wherein the improvement further comprises:

a circulating system located on each sides of said belt conveyor; each circulating system including a guide section that extends in the conveying direction and a turning means, said guide section being adjacent to and downstream of said turning means;

each of said circulating system includes a stopping and guiding element that extends in the direction of the circulating system and is of a length greater than said guide section;

said stopping and guiding elements being offset from each other and as a result of said circulating systems being driven synchronously, can be brought alternately from an operating position into a rest position;

when said stopping and guiding elements are in the rest position they are located outside the turning means and the guide section; and when said stopping and guiding elements are in the operating position, they run around the turning means, form said stop, and run in the guide section to thus form said guide.

30. The apparatus as claimed in claim 11 wherein the improvement further comprises:

said roller being provided with a guide belt that extends in the conveying direction.

* * * * *